US008082739B2

(12) United States Patent
Chila et al.

(10) Patent No.: US 8,082,739 B2
(45) Date of Patent: Dec. 27, 2011

(54) COMBUSTOR EXIT TEMPERATURE PROFILE CONTROL VIA FUEL STAGING AND RELATED METHOD

(75) Inventors: Ronald James Chila, Greer, SC (US); Mark Hadley, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/758,296

(22) Filed: Apr. 12, 2010

(65) Prior Publication Data

US 2011/0247314 A1 Oct. 13, 2011

(51) Int. Cl.
*F02C 7/22* (2006.01)

(52) U.S. Cl. ..... 60/776; 60/39.37; 60/733; 60/752; 60/760

(58) Field of Classification Search ..... 60/733, 60/735, 746, 772, 776, 39.37, 805, 752–760
See application file for complete search history.

(56) References Cited

U.S. PATENT DOCUMENTS

| | | | | |
|---|---|---|---|---|
| 2,520,967 | A * | 9/1950 | Schmitt | 60/735 |
| 3,701,255 | A * | 10/1972 | Markowski | 60/762 |
| 5,000,004 | A * | 3/1991 | Yamanaka et al. | 60/723 |
| 5,373,694 | A | 12/1994 | Clark | |
| 5,575,154 | A | 11/1996 | Loprinzo | |
| 6,405,536 | B1 | 6/2002 | Ho et al. | |
| 6,868,676 | B1 * | 3/2005 | Haynes | 60/776 |
| 7,000,396 | B1 | 2/2006 | Storey | |
| 7,000,400 | B2 | 2/2006 | Schumacher et al. | |
| 7,137,613 | B2 | 11/2006 | Jansen | |
| 7,373,772 | B2 | 5/2008 | Simons et al. | |
| 7,421,843 | B2 | 9/2008 | Laster et al. | |
| 2003/0024234 | A1 * | 2/2003 | Holm et al. | 60/746 |
| 2008/0264033 | A1 * | 10/2008 | Lacy et al. | 60/39.49 |
| 2009/0084082 | A1 * | 4/2009 | Martin et al. | 60/746 |
| 2010/0242482 | A1 * | 9/2010 | Kraemer et al. | 60/746 |

* cited by examiner

*Primary Examiner* — Ehud Gartenberg
*Assistant Examiner* — Lorne Meade
(74) *Attorney, Agent, or Firm* — Nixon & Vanderhye P.C.

(57) ABSTRACT

A gas turbine combustor includes a combustion chamber defined by a combustor liner, the combustor liner having an upstream end cover supporting one or more nozzles arranged to supply fuel to the combustion chamber where the fuel mixes with air supplied from a compressor. A transition duct is connected between an aft end of the combustion chamber liner and a first stage turbine casing, the transition duct supplying gaseous products of combustion to the first stage turbine nozzle. One or more additional fuel injection nozzles are arranged at an aft end of the transition duct for introducing additional fuel into the transition duct upstream of the first stage turbine nozzle.

13 Claims, 5 Drawing Sheets

COMBUSTOR EXIT TEMPERATURE PROFILE CONTROL VIA FUEL STAGING AND RELATED METHOD

This invention relates generally to gas turbine machinery and specifically, to a can-type combustor configured for late fuel injection for management of the combustor exit temperature profile.

BACKGROUND OF THE INVENTION

Gas turbines generally include a compressor, one or more combustors, a fuel injection system and a multi-stage turbine section. Typically, the compressor pressurizes inlet air which is then turned in direction or reverse-flowed to the combustors where it is used to cool the combustors and also to provide air to the combustion process. In some multi-combustor turbines, the combustors themselves are located in a circular arrangement about the turbine rotor, in what is generally referred to as a "can-annular" array, and transition ducts deliver combustion gases from each of the combustors to the first stage of the turbine section.

More specifically, in a typical gas turbine configuration, each combustor includes a generally cylindrical combustor casing secured to the turbine casing. Each combustor also includes a flow sleeve and a combustor liner substantially concentrically arranged within the flow sleeve. Both the flow sleeve and combustor liner extend between a double-walled transition duct at their downstream or aft ends, and a combustor liner cap assembly at their upstream or forward ends. The outer wall of the transition duct and a portion of the flow sleeve are provided with an arrangement of cooling air supply holes over a substantial portion of their respective surfaces, thereby permitting compressor air to enter the radial space between the inner and outer walls of the transition piece and between the combustor liner and the flow sleeve, and to be reverse-flowed to the upstream portion of the combustor where the airflow is again reversed to flow through the cap assembly and into the combustion chamber within the combustor liner. Dry low NOx (DLN) gas turbines typically utilize dual-fuel combustors that have both liquid and gas fuel capability. One common arrangement includes five dual-fuel nozzles surrounding a center dual-fuel nozzle, arranged to supply fuel and air to the combustion chamber.

At various operating conditions, however, and in order to attain a high efficiency, it is desirable to maintain relatively high combustion gas temperatures for introduction into the turbine first stage. However, maintaining combustion gas temperatures at the desired high level will often negatively impact the service life of the hot gas path components subjected to such high temperatures.

BRIEF SUMMARY

In accordance with a first exemplary but non-limiting embodiment, the present invention provides a gas turbine combustor comprising a combustion chamber defined by a combustion chamber liner, the liner having an upstream end cover supporting one or more nozzles arranged to supply fuel to the combustion chamber where the fuel mixes with air supplied from a compressor; a transition duct connected between a downstream end of the combustion chamber liner and a first stage turbine nozzle, the transition duct supplying gaseous products of combustion to the first stage turbine nozzle; and one or more additional fuel injection nozzles arranged at an aft end of the transition duct for introducing additional fuel and air for combustion into the transition duct upstream of the first stage turbine nozzle.

In accordance with another exemplary, nonlimiting aspect, there is provided a gas turbine comprising a compressor, a plurality of combustors arranged in an annular array, each combustor having one or more fuel nozzles arranged to supply fuel to a combustion chamber, each combustor having a transition duct for connecting the combustion chamber to a first stage turbine nozzle; one or more additional fuel injection nozzles located at an aft end of the transition duct; and a manifold arranged to supply fuel to the additional fuel injection nozzles of each transition duct.

In still another exemplary but nonlimiting aspect, there is provided a method of managing a combustor exit temperature profile comprising:(a) flowing combustion gases from a turbine combustion chamber to a first stage nozzle via a transition duct attached to one end to a combustor liner at least partially defining the combustion chamber; (b) arranging one or more fuel injection nozzles at an aft end of the transition duct remote from the combustion chamber; and (c) supplying an amount of fuel to the one or more fuel injection nozzles sufficient to achieve a desired combustor exit temperatures profile.

The invention will now be described in detail connection with the drawings identified below.

DETAILED DESCRIPTION OF THE INVENTION

Figure 1:
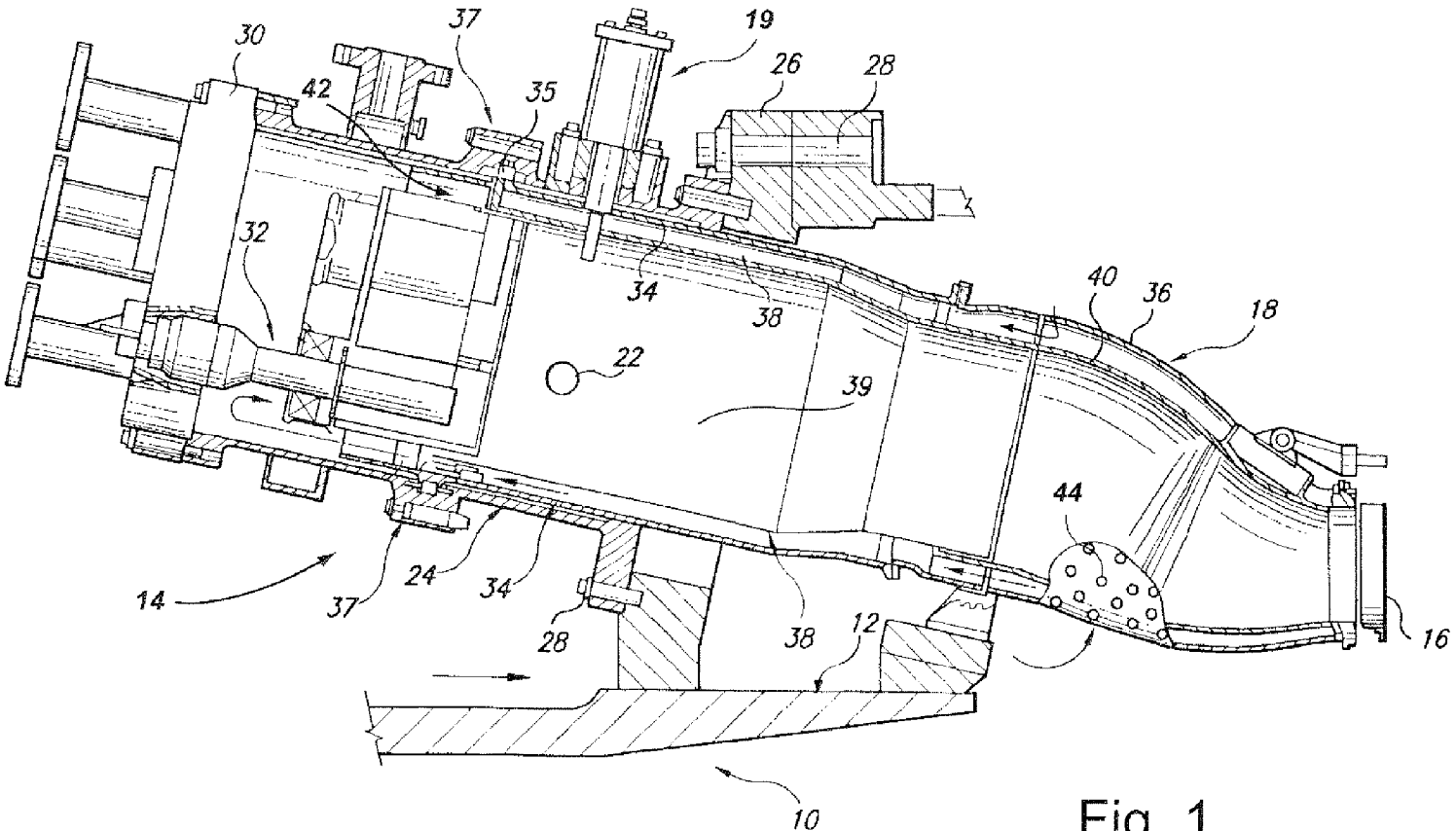
Fig. 1 (PRIOR ART)
FIG. 1 is a partial cross-section of a known gas turbine combustor.

With initial reference to FIG. 1, a known gas turbine 10 (partially shown) includes a compressor 12 (also partially shown), a plurality of can-annular-type combustors 14 (one shown), and a turbine section represented here by a single nozzle blade 16. Although not specifically shown, the turbine is drivingly connected to the compressor 12 along a common axis, i.e., the rotor axis. The compressor 12 pressurizes inlet air which is then reverse flowed to the combustor 14 where it is used to cool the combustor and to provide air to the combustion process. It will be appreciated, however, the invention is not limited to can-annular type combustors.

As noted above, a plurality of combustors 14 are located in an annular array about the axis of the gas turbine. A transition duct 18 connects the aft end of each combustor with the inlet end of the turbine to deliver the hot products of combustion to the turbine first stage. Ignition is achieved in the various combustors 14 by means of a spark initiating device 19 in conjunction with crossfire tubes 22 (one shown) in the usual manner.

Each combustor 14 includes a substantially cylindrical combustor casing 24 which is secured to the turbine casing 26 by means of bolts 28. The forward end of the combustor casing is closed by an end cover assembly 30 which includes supply tubes, manifolds and associated valves for feeding gaseous fuel, liquid fuel, air and water to the combustor as well understood in the art. The end cover assembly 30 also supports a plurality (for example, three to six) "outer" fuel nozzle assemblies 32 (only one shown in FIG. 1 for purposes of convenience and clarity), arranged in a circular array about a longitudinal axis of the combustor, and one center nozzle (not visible in FIG. 1).

Within the combustor casing 24, there is mounted, in substantially concentric relation thereto, a substantially cylindrical flow sleeve 34 which connects at its aft end to the outer wall 36 of the transition duct 18. The flow sleeve 34 is connected at its forward end by means of a radial flange 35 to the combustor casing 24 at a butt joint 37 where fore and aft sections of the combustor casing 24 are joined.

Within the flow sleeve 34, there is a concentrically-arranged combustor liner 38 defining a combustion chamber 39, and which is connected at its aft end with the inner wall 40 of the transition duct 18. The forward end of the combustor liner 38 is supported by a combustor liner cap assembly 42 which is, in turn, supported within the combustor casing 24 by a plurality of struts and an associated mounting assembly (not shown in detail).

The outer wall 36 of the transition duct 18 and the flow sleeve 34 may be provided with an array of apertures 44 to permit compressor discharge air to flow through the apertures 44 and into the annular space between the flow sleeve 34 and combustor liner 38 where it reverses flow toward the upstream end of the combustor (as indicated by the flow arrows in FIG. 1). This is a well known arrangement that needs no further discussion.

Figure 2:
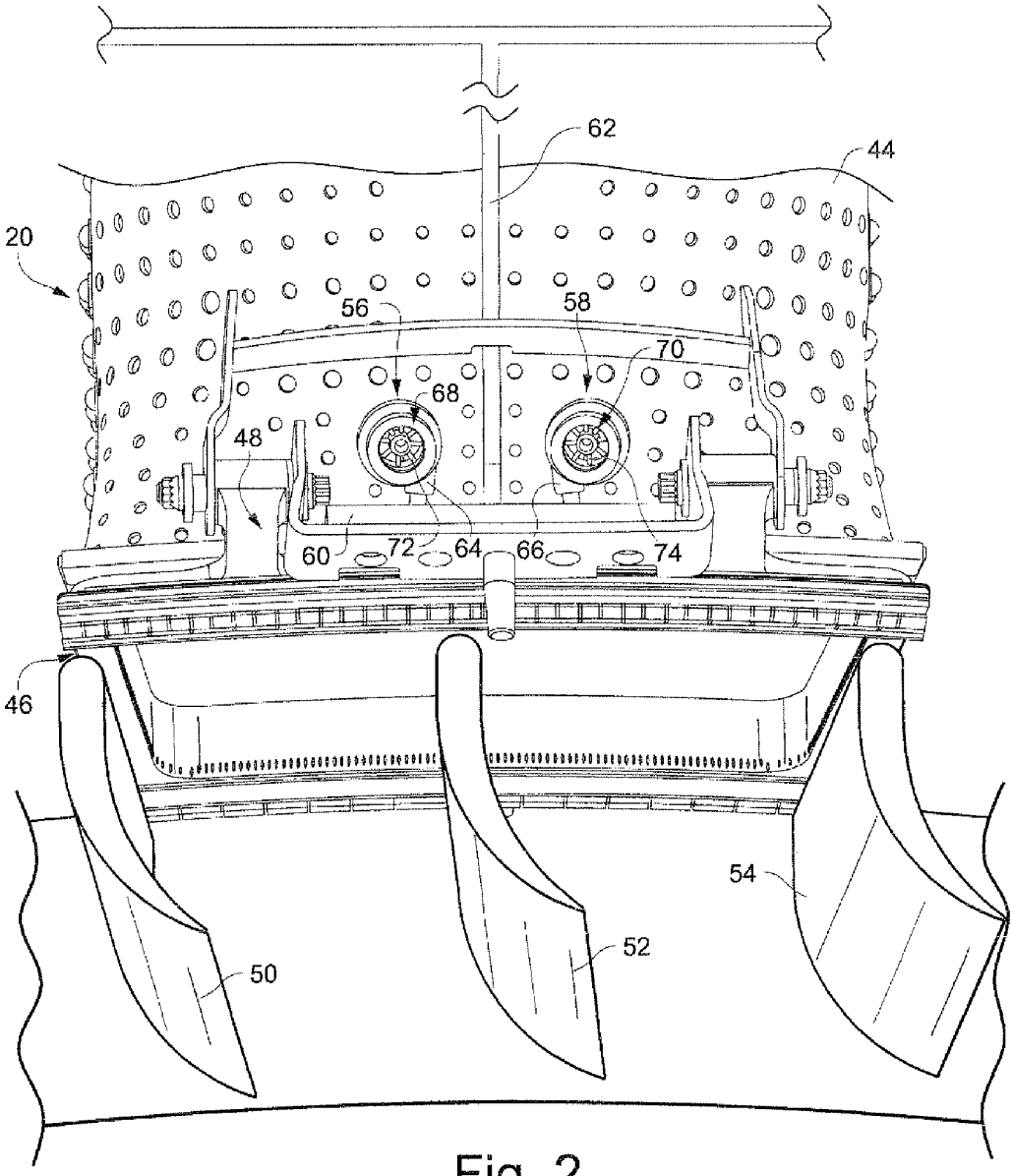
FIG. 2 is a top perspective, and partially schematic view of the interface between a combustor transition duct and a turbine first stage nozzle.

Turning to FIG. 2, a modified transition duct 20 is attached to the first stage of the turbine section at the aft end of the duct, defined by a relatively rigid peripheral frame member 46 and additional attachment hardware indicated generally at 48. The transition duct frame and attachment hardware are generally known and form no part of this invention. The turbine first stage nozzle is represented in FIG. 2 by a plurality of first stage nozzle vanes 50, 52 and 54 it being understood that the nozzle vanes are arranged in an annular array adjacent the blades or buckets attached to the first stage wheel of the turbine rotor (not shown).

In accordance with an exemplary but non limiting embodiment, two or more late lean fuel injection nozzles 56,58 (also referred to simply as "fuel injection nozzles") are mounted on the transition duct at its aft end 20 proximate the attachment hardware 48 and the rigid frame 46, and extending through the double-walled duct, i.e., outer wall 36 and inner wall 40. Fuel is supplied to the injection nozzles 56,58 by means of a manifold 60 and a supply conduit 62 which extends to another manifold (not shown) surrounding the aft ends of the array of can-annular combustors. Thus, the surrounding manifold will supply fuel to the fuel injection nozzles 56,58 and branch inlets 64,66 associated with each of the several combustor transition ducts.

Optionally, and without limitation on the invention described herein, the fuel injection nozzles 56,58 may have open upper ends 68,70 respectively which draw compressor discharge air into the nozzles to mix with the fuel supplied by the manifold 60. If desired, internal swirler devices 72,74 may also be included within the nozzles 56,58 to facilitate mixing of the air and fuel prior to injection into the modified transition duct 20. As will be understood by one of ordinary skill in the art, the size of the open ends 68,70 of the injection nozzles 56,58 would be chosen to draw in the desired amount of air for mixing with the fuel, and thereafter introduced into the transition duct substantially perpendicular to the flow of combustion gases within the duct. Ignition of the mixture may be achieved by any suitable and otherwise conventional means.

As also apparent from FIG. 2, the fuel injection nozzles 56,58 are located so as to be generally circumferentially between downstream pairs of the turbine stage one nozzle vanes 50,52 and 52,54, and on either side of a longitudinal axis of the transition duct. In the illustrated embodiment, therefore, the injection nozzle 56 is located circumferentially between the nozzle vanes 50 and 52, while the injection nozzle 58 is located circumferentially between the nozzle vanes 52 and 54. In the illustrated embodiment, three nozzle vanes are located generally within the exit opening profile of the modified transition duct 20. For other turbine applications, there may be four nozzle vanes within the outlet profile of the transition duct and that case, there may be three late lean fuel injection nozzles, also placed circumferentially between respective adjacent vane pairs.

Figure 6:
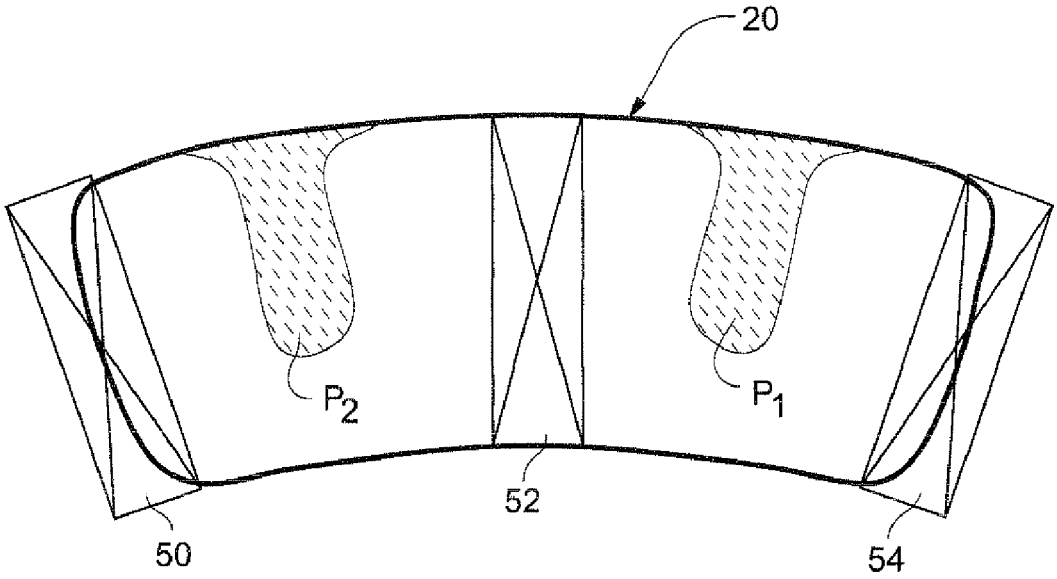
FIG. 6 is a schematic end view of the transition duct and nozzle vanes, illustrating the location of peak temperature regions relative to the duct wall and nozzle vanes in accordance with the exemplary but nonlimiting embodiment described herein.

By locating the late lean fuel injection nozzles 56,58 at the aft end of the modified transition duct 20, and in proper alignment the first stage nozzle vanes 50, 52 and 54, the average temperature profile of the combustor exit temperature may be maintained or even increased without exposing the hot gas path combustor components to peak temperatures. In other words, the late lean combustion occurs downstream of the combustion chamber 39 which is normally at a higher temperature than the aft end of the modified transition duct 20. In addition, the peak temperature regions produced by the late lean injection combustion are located away from the duct walls and circumferentially between the first stage nozzle vanes as depicted at $P_1$ and $P_2$ in FIG. 6.

Figure 3:
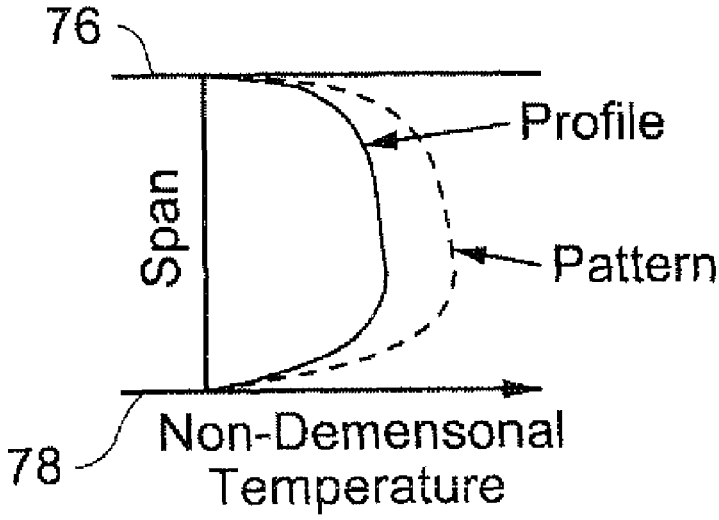
FIG. 3 is a diagrammatic illustration of average and peak temperature profiles at the exit end of a transition duct of a combustor that does not incorporate additional fuel nozzles in the transition duct as in an exemplary but non-limiting embodiment of the invention.
Figure 4:
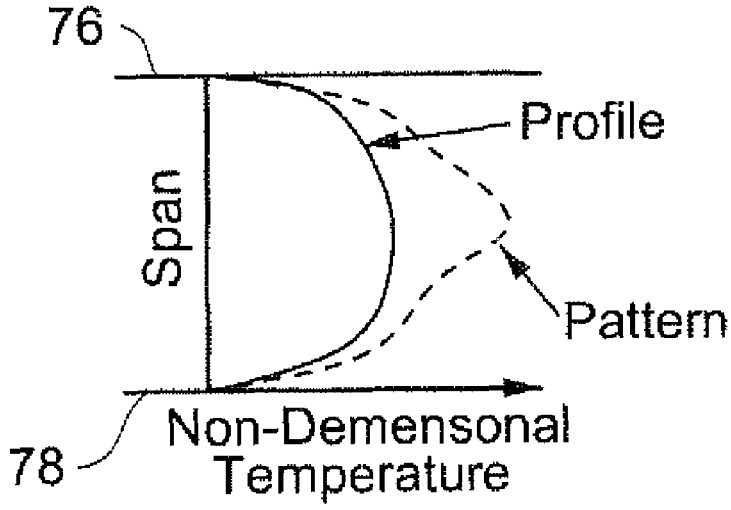
FIG. 4 is a diagrammatic illustration similar to FIG. 3 but illustrating the average and peak temperature profiles for a transition duct that does incorporate additional nozzles in accordance with an exemplary but non-limiting embodiment.

Another advantage of the present invention with respect to maintenance of a temperature exit profile but with increased service life of hot gas path components can also be seen from a comparison of FIGS. 3 and 4. In FIG. 3, the average temperature profile and peak temperature pattern are not perfectly symmetrical, indicating a so-called cold streak nearer one side of the transition duct side walls represented by the horizontal lines 76 and 78. In order to maintain a more uniform profile, the fuel feed to the late lean fuel injection nozzles 56,58 may be differentiated to provide more fuel on that side characterized by the cold streak than on the other side of the duct. By adding the late lean fuel injectors, the temperature profile may be made more uniform and, at the same time, and the temperature peak pattern may be diverted away from the side walls of the transition duct as shown in FIG. 4. In other words, while the average exit temperature remains unchanged as between FIGS. 3 and 4, the peak temperature pattern is engineered away from the transition duct side walls 76, 78.

In other words, the peak temperatures can be kept away from the metal parts, while the overall heat into to the turbine can be increased or adjusted to provide more uniform exit temperature profiles. This leads to a longer service life for the components and increased output efficiency for the turbine.

Figure 5:
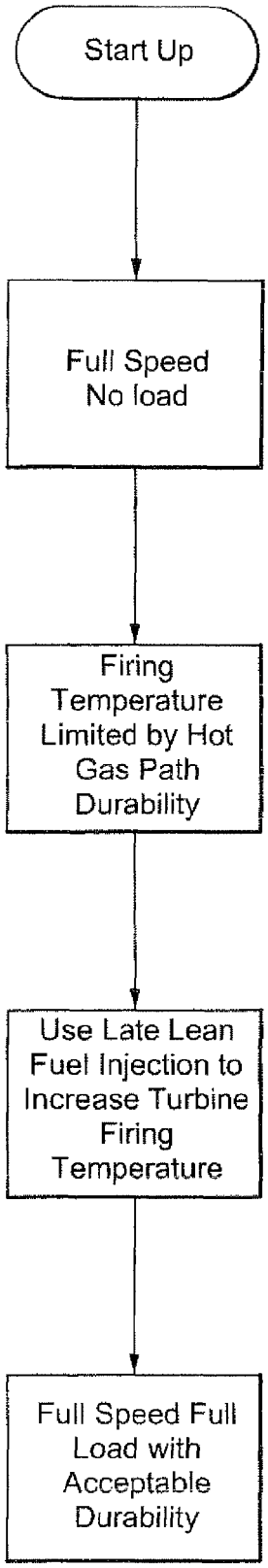
FIG. 5 is a flow diagram illustrating the various operating conditions of a turbine indicating the timing of the late lean fuel injection technique in accordance with an exemplary but non-limiting embodiment disclosed herein.

FIG. 5 illustrates in flowchart form, the various operating conditions of the turbine from start up to full-speed to full-load. More specifically after start up, the turbine is brought up to a full speed no-load condition, and subsequently to a firing temperature that is normally limited by hot gas path component durability. By using the late lean fuel injection in accordance with the embodiments described herein, the turbine firing temperature can be increased without negatively impacting the hot gas path durability, and the turbine may be brought to a full-speed full-load condition with acceptable component durability.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A gas turbine combustor comprising:

a combustion chamber defined by a combustor liner, said combustor liner having an upstream end cover supporting one or more nozzles arranged to supply fuel to the combustion chamber where the fuel mixes with air supplied from a compressor; a transition duct connected between a downstream end of said combustor liner and a first stage turbine nozzle, said transition duct supplying gaseous products of combustion to said first stage turbine nozzle; and a plurality of fuel injection nozzles arranged at an aft end of said transition duct for introducing additional fuel and air for combustion into said transition duct upstream of said first stage turbine nozzle, said plurality of fuel injection nozzles located proximate to and circumferentially between vanes of said first stage turbine nozzle, wherein each of said plurality of fuel injection nozzles is formed with an open end to draw air from surrounding compressor discharge air, and a swirler for mixing the compressor discharge air with fuel supplied to said plurality of fuel injection nozzles.

2. The gas turbine combustor of claim 1 wherein said plurality of fuel injection nozzles are arranged to introduce additional fuel and air in a direction substantially perpendicular to flow of gaseous products of combustion in said transition duct.

3. The gas turbine combustor of claim 2 wherein said plurality of fuel injection nozzles comprise at least a pair of fuel injection nozzles arranged on either side of a longitudinal axis of said transition duct, circumferentially between three adjacent vanes of said first stage turbine nozzle.

4. The gas turbine combustor of claim 1 wherein said plurality of fuel injection nozzles comprise three fuel injection nozzles.

5. The gas turbine combustor of claim 1 wherein said plurality of fuel injection nozzles are located to increase inlet temperature at the first stage turbine nozzle but to move higher peak temperatures away from surfaces of said transition duct and said vanes of said first stage turbine nozzle.

6. The gas turbine combustor of claim 1 wherein fuel supplied to said plurality of fuel injection nozzles is introduced differentially such that more fuel is supplied to regions of relatively cooler combustion gas temperatures.

7. A gas turbine comprising:

a compressor, a plurality of combustors arranged in an annular array, each combustor having one or more fuel nozzles arranged to supply fuel to a combustion chamber, each combustor having a transition duct for connecting the combustion chamber to a first stage turbine nozzle; a plurality of fuel injection nozzles located at an aft end of said transition duct; and a manifold arranged to supply fuel to said plurality of fuel injection nozzles of each transition duct, wherein said plurality of fuel injection nozzles comprise one less than the number of first stage turbine nozzle vanes that are at least partially exposed within an exit opening profile of said transition duct, said plurality of fuel injection nozzles located proximate to and circumferentially between said first stage turbine nozzle vanes, wherein each of said plurality of fuel injection nozzles have open ends for drawing compressor discharge air into the fuel injection nozzle and a swirler for mixing fuel and air within the fuel injection nozzle.

8. The gas turbine of claim 7 wherein said plurality of fuel injection nozzles are arranged to introduce additional fuel in a direction substantially perpendicular to flow of gaseous products of combustion in said transition duct, said plurality of fuel injection nozzles located proximate to and circumferentially between vanes of said first stage turbine nozzle.

9. The gas turbine of claim 7 wherein said plurality of fuel injection nozzles are located to increase inlet temperature at the first stage turbine nozzle but to move higher peak temperatures away from proximate surfaces of said transition duct and said first stage turbine nozzle vanes.

10. A method of managing a combustor exit temperature profile comprising:

(a) flowing combustion gases from a turbine combustion chamber to a first stage turbine nozzle via a transition duct attached to one end to a combustor liner at least partially defining said combustion chamber;

(b) arranging a plurality of fuel injection nozzles at an aft end of said transition duct remote from said combustion chamber; and (c) supplying an amount of fuel to said plurality of fuel injection nozzles sufficient to achieve a desired combustor exit temperatures profile, wherein step (b) is implemented by locating said plurality of fuel injection nozzles adjacent and circumferentially between proximate first stage turbine nozzle vanes, wherein each of said plurality of fuel injection nozzles draws compressor discharge air into a swirler for mixing said fuel and said compressor discharge air within each of said plurality of fuel injection nozzles.

11. The method of claim 10 wherein, during step (c) fuel is supplied in different amounts to each of said plurality of fuel injection nozzles.

12. The method of claim 10 wherein said plurality of fuel injection nozzles comprise one less than the number of said first stage turbine nozzle vanes that are at least partially exposed within an exit opening profile of said transition duct.

13. The method of claim 10 wherein said plurality of fuel injection nozzles are arranged to introduce additional fuel in a direction substantially perpendicular to flow of gaseous products of combustion in said transition duct.

* * * * *